US011569589B2

(12) United States Patent
Soward et al.

(10) Patent No.: US 11,569,589 B2
(45) Date of Patent: Jan. 31, 2023

(54) ELECTRICAL POWER TAP CONNECTOR

(71) Applicant: TRAXXAS, L.P., McKinney, TX (US)

(72) Inventors: Terry Soward, Van Alstyne, TX (US); Jonathan Scott Wood, Frisco, TX (US); Kent Poteet, Lucas, TX (US); Otto Karl Allmendinger, Rowlett, TX (US)

(73) Assignee: TRAXXAS, L.P., McKinney, TX (US)

( * ) Notice: Subject to any disclaimer, the term of this patent is extended or adjusted under 35 U.S.C. 154(b) by 0 days.

(21) Appl. No.: 17/220,192

(22) Filed: Apr. 1, 2021

(65) Prior Publication Data

US 2021/0313711 A1 Oct. 7, 2021

Related U.S. Application Data

(60) Provisional application No. 63/006,158, filed on Apr. 7, 2020.

(51) Int. Cl.

| | |
|---|---|
| ***H01R 13/512*** | (2006.01) |
| ***H01R 4/18*** | (2006.01) |
| ***H01R 4/02*** | (2006.01) |

(52) U.S. Cl.

CPC ..... *H01R 4/185* (2013.01); *H01R 4/023* (2013.01); *H01R 13/512* (2013.01)

(58) Field of Classification Search

CPC ..... H01R 4/185; H01R 4/023; H01R 13/512; H01R 24/28; H01R 4/4809; H01R 4/489; H01R 2103/00; H01R 2201/26; G02B 6/3893

See application file for complete search history.

(56) References Cited

U.S. PATENT DOCUMENTS

| | | | |
|---|---|---|---|
| 2,121,338 | A | 6/1938 | Chirelstein |
| 2,203,122 | A | 6/1940 | Anderson |
| D179,946 | S | 3/1957 | Kerr |
| 2,838,739 | A | 6/1958 | Winkler |
| 3,091,746 | A | 5/1963 | Winkler |
| 3,145,067 | A | 8/1964 | Benjamin et al. |
| 3,218,599 | A | 11/1965 | Winkler |
| 3,233,211 | A | 2/1966 | Smith |
| 3,259,870 | A | 7/1966 | Winkler |
| 3,794,957 | A | 2/1974 | Winkler |
| 4,018,497 | A | 4/1977 | Bulanchuk |

(Continued)

FOREIGN PATENT DOCUMENTS

| | | | |
|---|---|---|---|
| DE | 704450 | C | 3/1941 |
| EP | 0318831 | A2 | 6/1989 |
| FR | 1036107 | A | 9/1953 |

*Primary Examiner* — Michael C Zarroli

(74) *Attorney, Agent, or Firm* — Daryl R. Wright; Greg Carr

(57) ABSTRACT

An electrical power tap connector for a model vehicle is provided including a first power tap housing. The first power tap housing contains a power tap terminal configured to electrically couple with a connector terminal of an electrical connector. The power tap connector also includes a second power tap housing releasably securable to the first power tap housing and a releasable locking mechanism configured to physically secure the power tap connector to the electrical connector. Wherein the power tap terminal is configured to electrically couple with the connector terminal via a non-mating end of the electrical connector.

18 Claims, 6 Drawing Sheets

(56) References Cited

U.S. PATENT DOCUMENTS

| | | | |
|---|---|---|---|
| 4,083,617 | A | 4/1978 | Wyatt |
| D258,429 | S | 3/1981 | Buckler |
| 4,342,498 | A | 8/1982 | Patton et al. |
| 4,630,876 | A | 12/1986 | Grunberg et al. |
| 4,846,729 | A | 7/1989 | Hikami et al. |
| 4,990,099 | A | 2/1991 | Marin et al. |
| D326,642 | S | 6/1992 | Lowe |
| 5,123,071 | A | 6/1992 | Mulholland et al. |
| 5,293,581 | A | 3/1994 | DiMarco |
| 5,533,915 | A | 7/1996 | Deans |
| 5,575,674 | A | 11/1996 | Davis et al. |
| 5,748,821 | A | 5/1998 | Schempp et al. |
| D430,542 | S | 9/2000 | Hoferitza et al. |
| 6,240,228 | B1 | 5/2001 | Chen et al. |
| 6,268,564 | B1 | 7/2001 | Miyakoshi |
| 6,318,904 | B1 | 11/2001 | Reichle |
| D467,553 | S | 12/2002 | Cheng |
| 6,488,546 | B2 | 12/2002 | Sakurai et al. |
| 6,619,995 | B1 | 9/2003 | Hayashi et al. |
| 6,619,996 | B2 | 9/2003 | Hara et al. |
| 6,623,309 | B2 | 9/2003 | Sakurai et al. |
| 6,645,003 | B2 | 11/2003 | Yoshida et al. |
| 6,761,488 | B2 | 7/2004 | Weigel |
| D494,933 | S | 8/2004 | Lu |
| 7,004,795 | B2 | 2/2006 | Mancini et al. |
| D552,560 | S | 10/2007 | Victor |
| 7,325,980 | B2 | 2/2008 | Pepe |
| 7,374,460 | B1 | 5/2008 | Hariharesan et al. |
| D573,536 | S | 7/2008 | Hariharesan et al. |
| D576,557 | S | 9/2008 | Hariharesan et al. |
| D577,671 | S | 9/2008 | Schnitzler |
| D589,881 | S | 4/2009 | Kok et al. |
| D642,528 | S | 8/2011 | Gravolin et al. |
| D659,640 | S | 5/2012 | Tseng |
| D662,889 | S | 7/2012 | Smith |
| D665,748 | S | 8/2012 | Baker et al. |
| 8,491,341 | B2 | 7/2013 | Bower et al. |
| D743,338 | S | 11/2015 | Christensen et al. |
| D743,339 | S | 11/2015 | Christensen et al. |
| D801,271 | S | 10/2017 | Tanaka |
| 10,027,146 | B2 | 7/2018 | Christensen et al. |
| D830,966 | S | 10/2018 | Siminoff et al. |
| D836,549 | S | 12/2018 | Kim |
| D837,734 | S | 1/2019 | Vinciarelli et al. |
| D851,032 | S | 6/2019 | Santos et al. |
| D860,131 | S | 9/2019 | Siminoff et al. |
| D913,212 | S | 3/2021 | Ouyang |
| 2009/0311919 | A1 | 12/2009 | Smith et al. |
| 2011/0003512 | A1 | 1/2011 | Bower et al. |
| 2015/0126075 | A1 | 5/2015 | Chen et al. |
| 2018/0102599 | A1 | 4/2018 | Onoda et al. |
| 2018/0261944 | A1* | 9/2018 | Papageorge ..... H01R 24/30 |
| 2020/0243997 | A1* | 7/2020 | Horning ..... H05K 7/1492 |

* cited by examiner

ELECTRICAL POWER TAP CONNECTOR

RELATED APPLICATIONS

This application claims the benefit of a related U.S. Provisional Application Ser. No. 63/006,158, filed Apr. 7, 2020, entitled "ELECTRICAL POWER TAP CONNECTOR," to Terry Soward, et. al., the disclosure of which is incorporated by reference herein in its entirety.

BACKGROUND

The following descriptions and examples are not admitted to be prior art by virtue of their inclusion in this section.

In the Radio Controlled (RC) model vehicle industry, optional equipment such as lighting, vehicle winches, and other accessories, may require a source of low current power for use in auxiliary circuits. RC model vehicles typically have a single supply of stored power, a battery pack with an attached high current electrical connector. This high current connector is typically attached to an Electronic Speed Control (ESC). The ESC may provide a source of low current power to the radio receiver and attached servos through the use of a Battery Elimination Circuit (BEC). In addition, the ESC may also provide a source of high current power to the RC model vehicle motor.

However, it can be difficult connecting to existing or earlier generations of electrical connectors and wiring harnesses. The connectors and harnesses are typically designed to a set of very specific requirements suitable for a particular application. For example, the high current connector from the battery pack will generally comprise only two higher current capacity wires. In order to obtain a source of optional low current power for additional or accessory equipment, a user would have to cut and splice lower current capacity wires into the existing high current wire harnesses. For an inexperienced user, this could result in potential reliability problems as the waterproof nature of an RC model vehicle may be compromised and/or the intermittent loss of power from the lack of a robust and appropriate solder or splice joint between the power tap wires and the existing harnesses.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with one embodiment, an electrical power tap connector for a model vehicle is provided. The electrical power tap connector may include a power tap housing containing a power tap terminal having a power tap terminal contact. Wherein the power tap terminal contact is configured to electrically couple with an electrical terminal provided in an electrical connector via a non-mating end of the electrical connector. In addition, wherein the power tap connector is configured to be physically secured in position relative to the electrical connector via a releasable locking mechanism.

In accordance with another embodiment of the current disclosure, a model vehicle including an electrical connector is provided. The electrical connector may include a first connector terminal electrically coupled to a first connector wire and a second connector terminal electrical coupled to a second connector wire. In addition, the electrical connector may include a connector housing comprising a mating end and a non-mating end.

The model vehicle may also include a power tap connector comprising a power tap housing that contains a power tap terminal electrically coupled to a power tap wire and including a power tap terminal contact. In addition, the power tap connector may include a releasable locking mechanism physically coupling the power tap connector to the electrical connector. Wherein the power tap terminal contact electrically couples with one of the first connector terminal or the second connector terminal via the non-mating end of the connector housing.

According to a further embodiment, a power tap connector for a model vehicle is provided. The power tap connector may include a first power tap housing containing a power tap terminal configured to electrically couple with a connector terminal of an electrical connector. The power tap connector may also include a second power tap housing releasably securable to the first power tap housing and a releasable locking mechanism configured to physically secure the power tap connector to the electrical connector. Wherein the power tap terminal may be configured to electrically couple with the connector terminal via a non-mating end of the electrical connector.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following specification, numerous specific details are set forth to provide a thorough understanding of embodiments of the present disclosure. However, those skilled in the art will appreciate that the embodiments may be practiced without such specific details and that numerous variations or modifications from the described embodiments may be possible. In other instances, well-known elements have been illustrated in schematic or block diagram form in order not to obscure embodiments of the present disclosure in unnecessary detail.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

Figure 1:
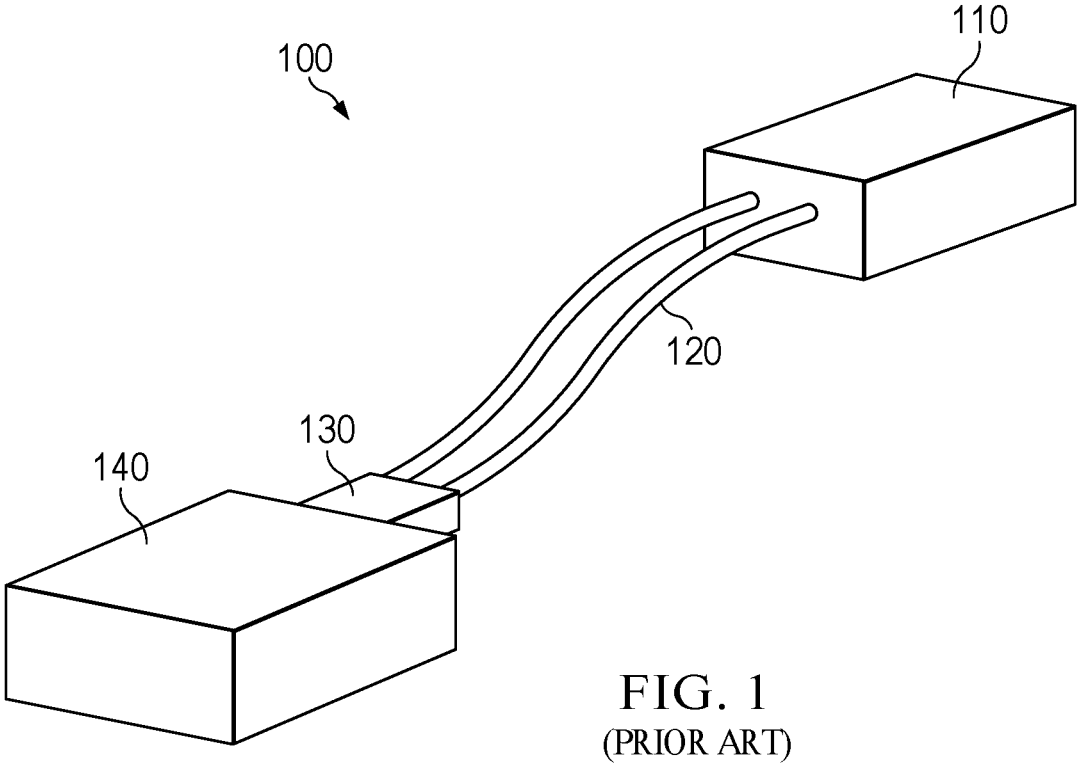
FIG. 1 (PRIOR ART)
FIG. 1 is a perspective schematic showing a prior art electrical system.

Adding an optional accessory to a radio controlled (RC) model vehicle that originally did not include a low current power supply may provide challenges for a user of that RC model vehicle. Referring generally to FIG. 1, in some cases the main source of stored energy in an RC model vehicle energy system 100 is the battery pack 110. The high current power from the battery pack 110 is electrically coupled to the electronic speed control (ESC) 140 via high current wires 120 and an electrical connector 130. The electrical connector 130 releasably couples with a corresponding electrical connector (not shown in this figure) provided in the ESC 140. The corresponding electrical connector is designed to electrically couple with the electrical connector 130. When the user wants to add an optional electrically powered accessory such as lighting (among others) to their RC model vehicle, the user would have to somehow tap into or otherwise access the energy being transferred between the battery pack 110 and the ESC 140.

Previous methods of modification have included the use of specially designed components such as splice connectors, 3M®'s Quick Splices for example, among others, which make an electrical connection in the high current wires 120 electrically coupling the battery pack 110 and the ESC 140. Splice connectors cut through the insulation of the high current wires 120 and establish an electrical connection via the electrically conductive metal cutting component of the splice connector.

However, splice connectors carry risks due to physical damage of the wires underlying the insulation by the metal cutting components. In addition, splice connectors may potentially compromise the water resistance of the energy system 100 at the electrical connection points. The splice connector may further impact electrical reliability at the connection points due to the small electrical contact area of the splice connector. Also, the connections made via splice connectors are not easily reversible due to the damaged insulation of the connected wires.

Still other methods included soldering a low current wire directly to the high current wire. Such a modification requires the use of appropriate skills and tools in order to accurately heat the wire and then solder and join the separate wires into a robust joint. In addition, since the insulation has been compromised in order to join the wires together, the soldered connection needs to be waterproofed and re-insulated. A solid and reliable connection is directly determined by the skill level of the user fabricating the connection. Some embodiments of the current disclosure comprise an electrical power tap connector 200 that is configured to physically and electrically couple with the existing electrical connector 130.

Figure 2B:
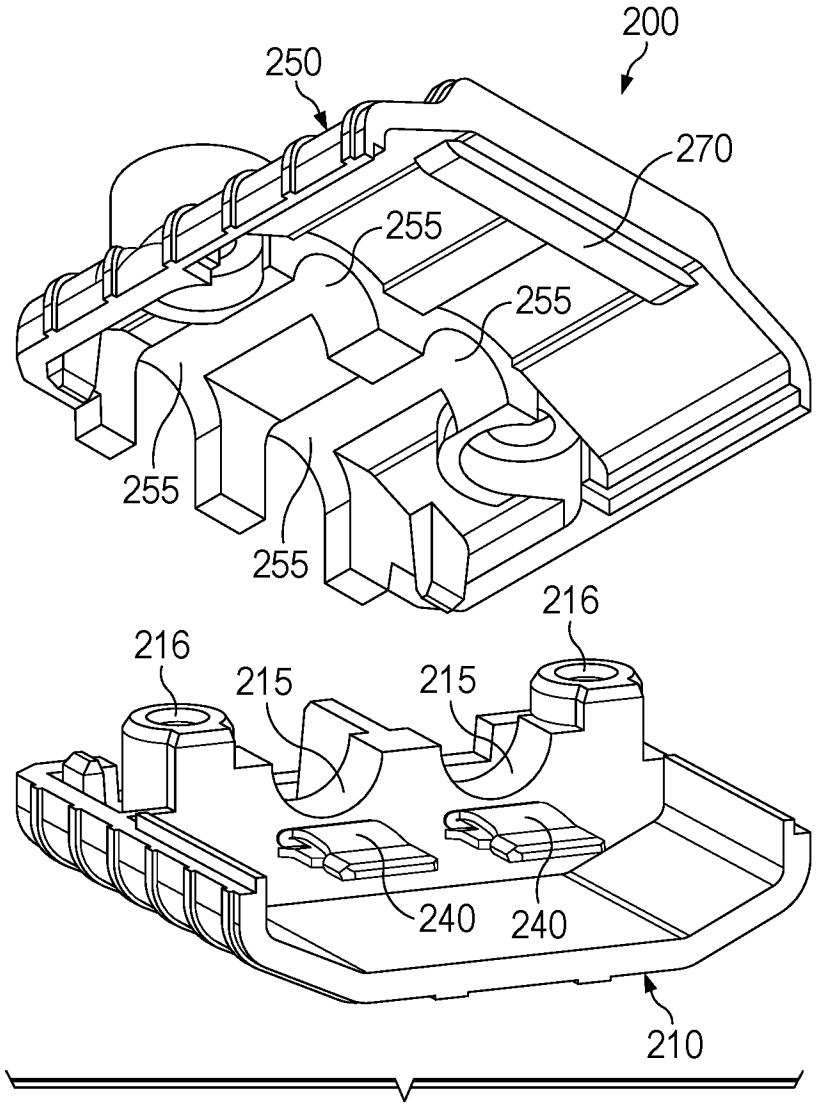
FIG. 2B is an upper, front, side perspective assembly view of the power tap connector of FIG. 2A, in accordance with an embodiment of the disclosure.
Figure 2A:
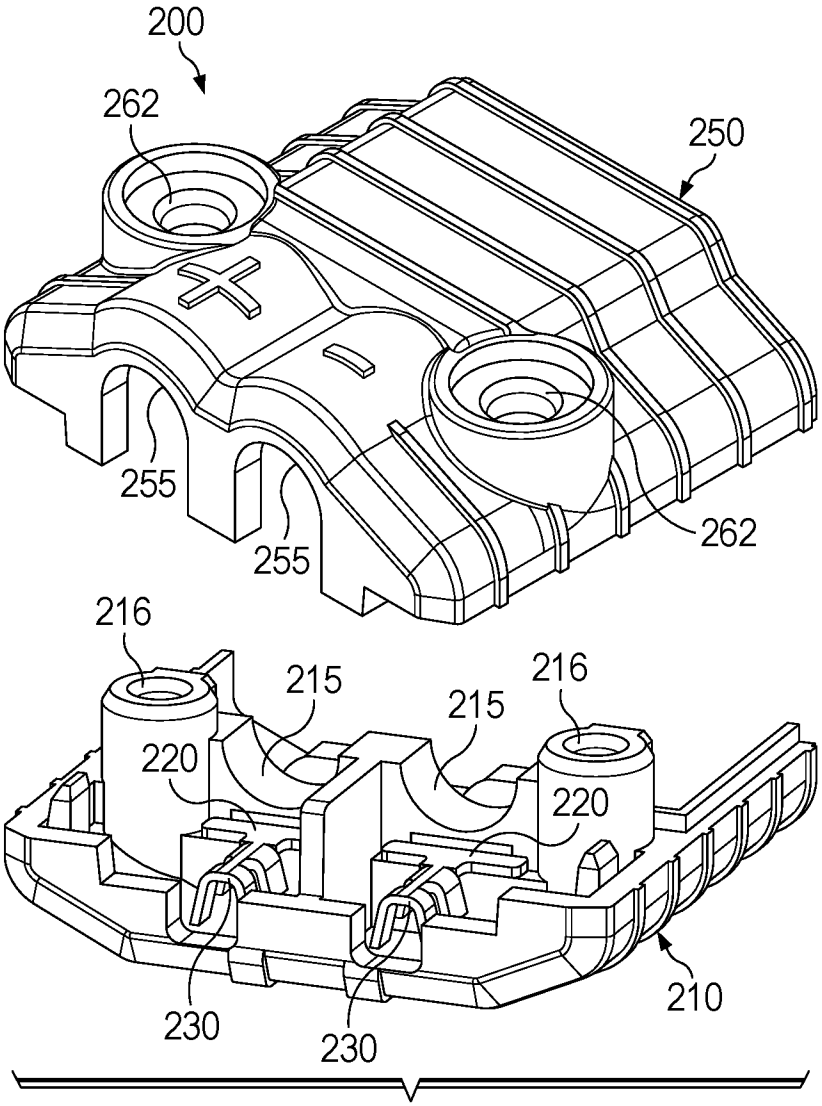
FIG. 2A is an upper, rear, side perspective assembly view of a power tap connector, in accordance with an embodiment of the disclosure.
Figure 5A:
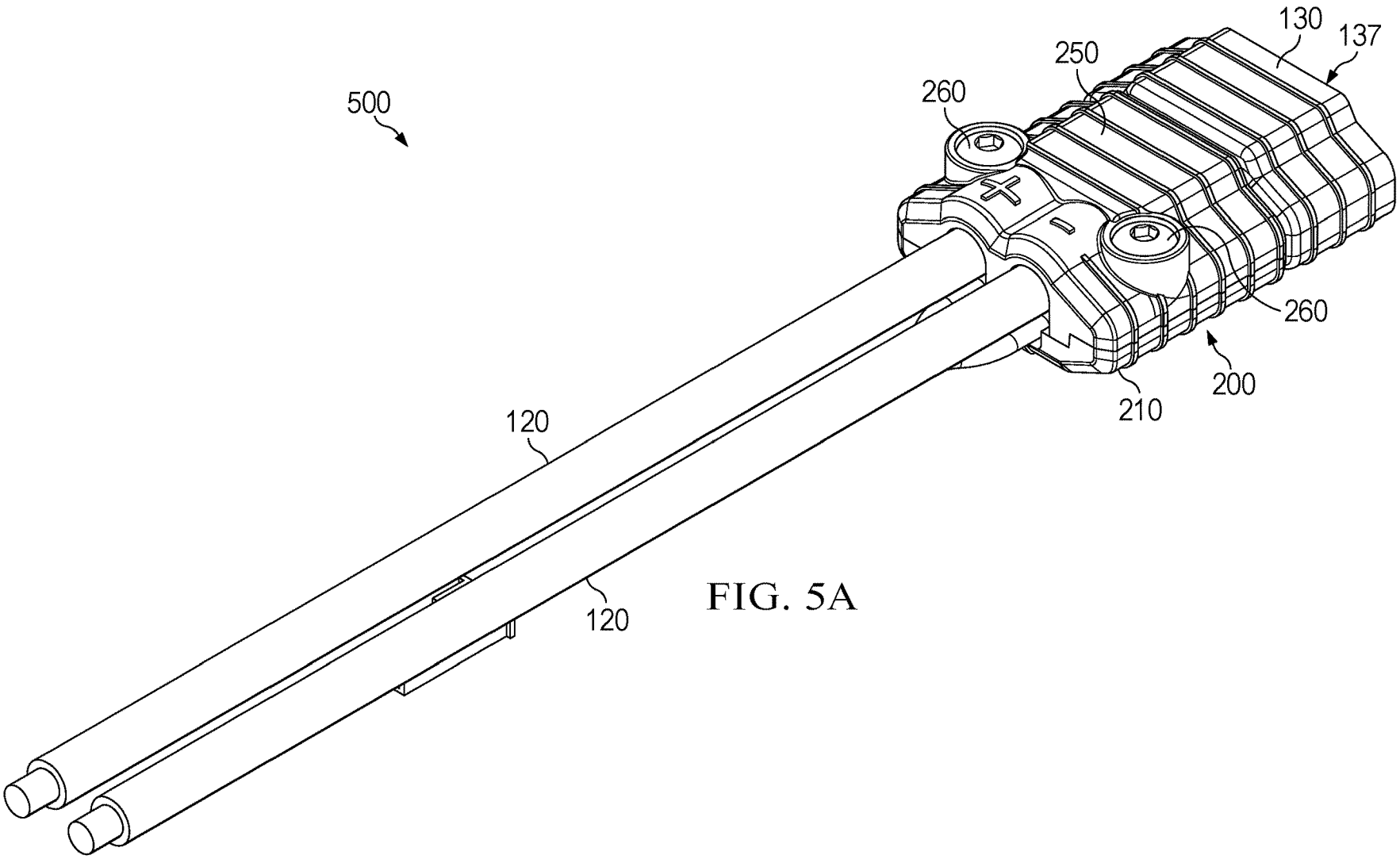
FIG. 5A is an upper, rear, side perspective schematic view of a power tap system, according to an embodiment of the disclosure.

Referring generally to FIGS. 2A and 2B, one embodiment of an electrical power tap connector 200 according to the current disclosure includes a lower or first power tap housing 210 and an upper or second power tap housing 250 (relative to the orientation shown in the figures), releasably fastenable together via a securing mechanism 260 (see FIG. 5A). In this embodiment, the securing mechanism 260 is characterized as threaded fasteners, although in other embodiments snap fits, hinged connectors, clasp systems, and other mechanisms or components may be used to couple the two power tap housings together.

In some cases, the lower or first power tap housing 210 may be inserted into the non-mating end 135 (See FIG. 4B) of the electrical connector 130 and establish an electrical connection with the electrical connector's 130 high current terminals. A portion of the lower or first power tap housing 210 may be configured to surround or encompass a portion of the non-mating end 135 of the housing 133 of the electrical connector 130. The upper or second power tap housing 250 may then be joined with the lower power tap housing 210 and be coupled to both the lower power tap housing 210 and the electrical connector 130, establishing a relatively secure physical coupling between the power tap connector 200 and the electrical connector 130.

In this embodiment the lower and upper power tap housings 210, 250 are shown as separate and distinct components, divided horizontally approximately in half. In still other embodiments, the lower and upper power tap housings 210, 250 may be hingedly coupled on one side and fastened on the other, or in some cases may comprise a single unitary housing (depending upon application).

Figure 3A:
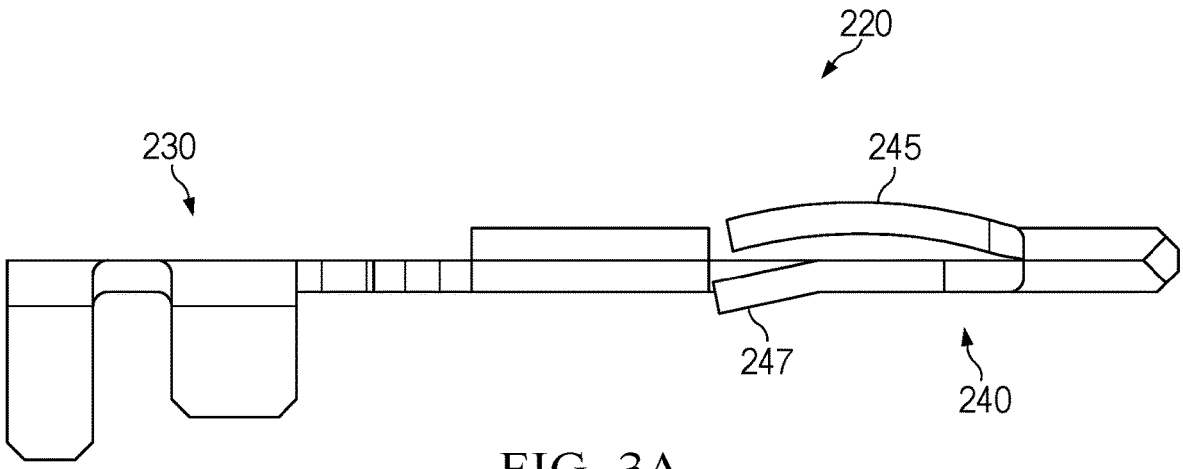
FIG. 3A is an elevated side view of a power tap terminal, in accordance with an embodiment of the disclosure.
Figure 3B:
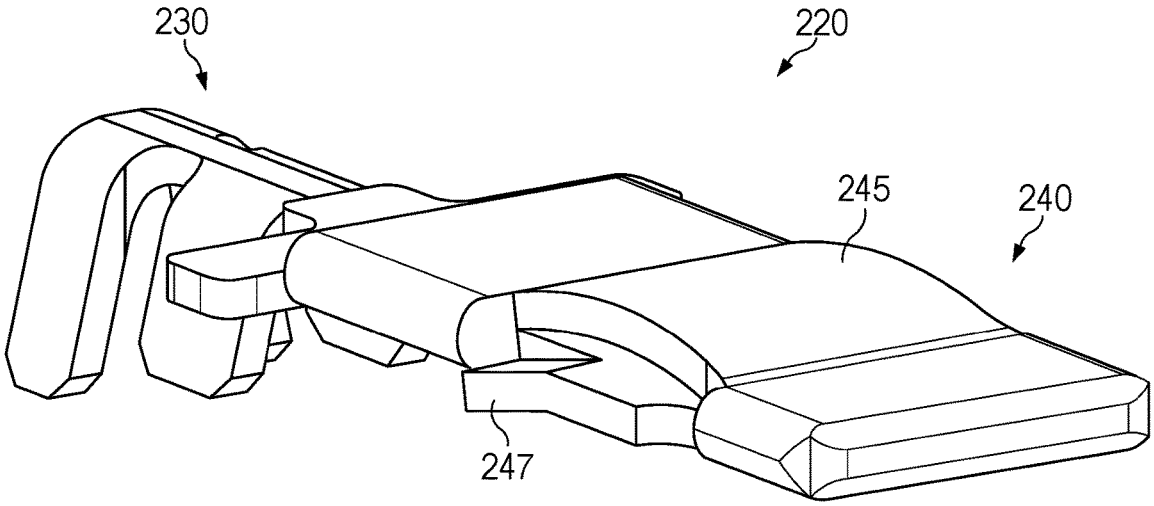
FIG. 3B is an upper, front, side perspective view of the power tap terminal of FIG. 3A, in accordance with an embodiment of the disclosure.

The lower or first power tap housing 210 may comprise one or more power tap terminals 220 (for example, two are shown in this embodiment). Referring to FIGS. 3A and 3B, each of the power tap terminals 220 may further comprise a power tap wire interface 230 and a power tap terminal contact 240. The power tap terminal contact 240 may also comprise a power tap contact arch 245 and a power tap terminal securing tab 247. For this embodiment, the power tap wire interface 230 is represented as a wire crimping connection, while in other embodiments, the low current wire may be directly soldered to the power tap wire interface 230 or make use of another wire interfacing mechanism as appropriate.

Figure 5B:
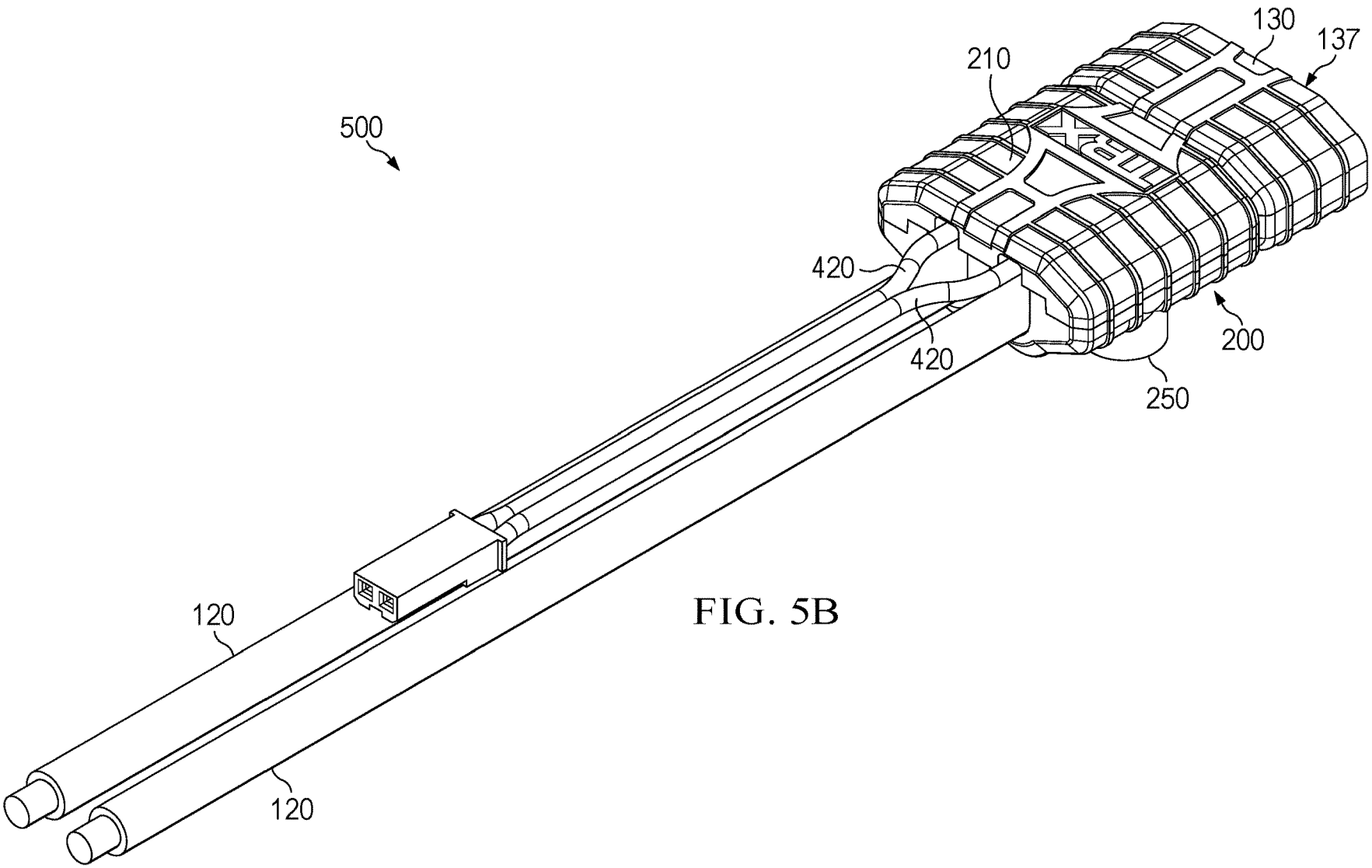
FIG. 5B is a lower, rear, side perspective view of the power tap system of FIG. 5A, according to an embodiment of the disclosure.

The power tap wire interface 230 of the power tap terminal 220 may be configured to be attached to a low current wire (not shown in these figures, but may be seen as low current wires 420 in FIG. 5B). The low current wires 420 are referred to as low current in comparison to the high current wires 120 shown in FIG. 1. The use of low current and high current as descriptors is merely to provide a distinction between the wires. These wires may also be referred to as a first set and a second set of wires or battery wires and accessory wires where in some embodiments one set of wires has different cross-sectional diameters (i.e. different wire gauges) than the other set. In still other embodiments, the first set and the second set of wires may have the same cross-sectional diameters.

The power tap terminal 220 may be directly inserted into a slot provided in the lower power tap housing 210. The power tap terminal 220 may be directed in an insertion direction until the power tap terminal securing tab 247 secures the power tap terminal contact 240 in a position to contact the high current wire terminal interface (not shown in these figures). In this embodiment, the power tap terminal securing tab 247 may elastically engage the lower power tap housing 210 and inhibit removal of the power tap terminal 220 in a direction opposite to the insertion direction of the power tap terminal 220. In some other embodiments, the power tap terminals 220 may be configured to be removed from the lower power tap housing 210 (or single unitary power tap housing) when a retention force threshold is exceeded by the removal force.

The lower power tap housing 210 may provide an insulated barrier 217 to separate the two power tap terminals 220 from one another. In addition, in some other embodiments, the high current wires 120 may fit into wire separators 215, curved to match the exterior profile of the high current wires 120. Since this exemplary embodiment is described using threaded fasteners for the securing mechanisms 260, posts 216 are provided to engage with the threads of the securing mechanism 260. This feature may change depending upon the selection of an appropriate securing mechanism.

The upper power tap housing 250 may comprise wire separators 255, similar to wire separators 215 in the lower power tap housing 210. In the upper power tap housing 250, some configurations may include two sets of wire separators 255 and an insulated barrier 257 to separate and insulate the individual high current wires 120. As with the wire separators 215, the wire separators 255 may be configured to correspond to the exterior profile of the high current wires 120.

In addition, the upper power tap housing 250 may include orifices 262 to provide access for the threaded fasteners 260 to engage the posts 216 of the lower power tap housing 210. In some embodiments the upper power tap housing 250 may further include a power tap connector retention feature 270. The power tap connector retention feature 270 may engage an edge 134 of the electrical connector's 130 housing 133 and inhibit separation of the power tap connector 200 from the electrical connector 130. In some embodiments, the power tap connector retention feature 270 may provide a locking function between the power tap connector 200 and the electrical connector 130.

Figure 4A:
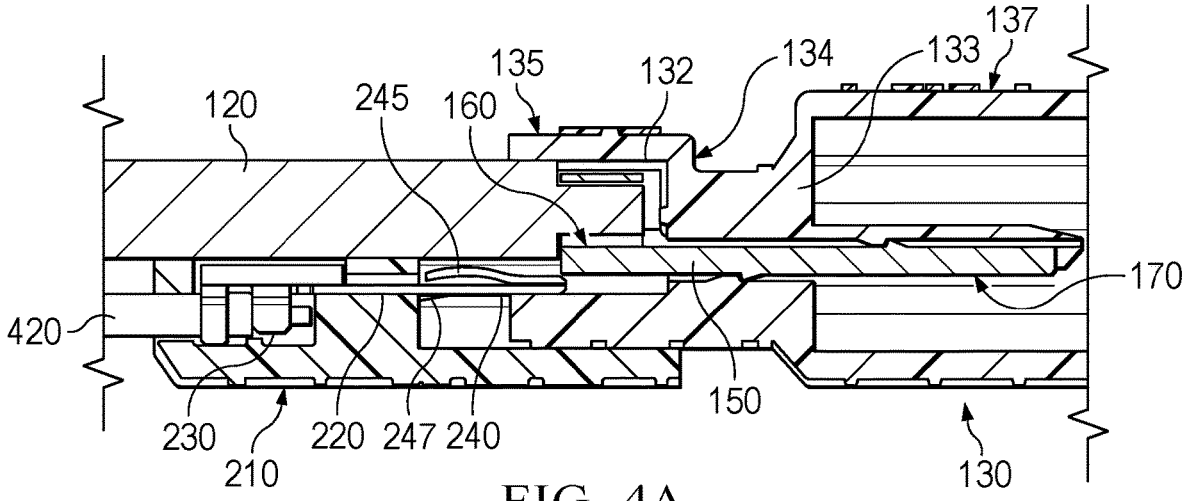
FIG. 4A is a side cross-sectional schematic view of a lower power tap housing assembly partially inserted into an existing electrical connector, in accordance with an embodiment of the disclosure.
Figure 4B:
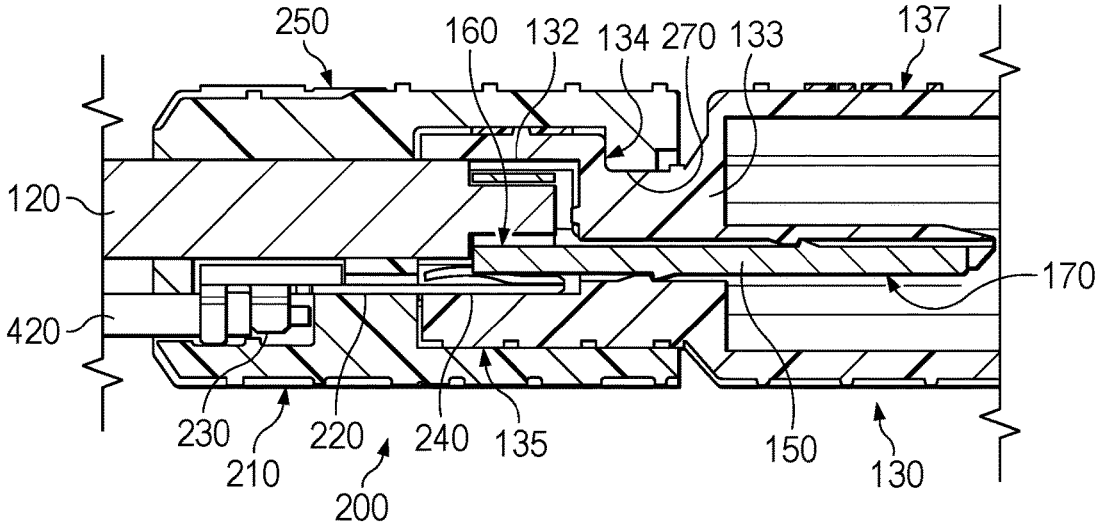
FIG. 4B is a side cross-sectional schematic view of a power tap connector fully inserted into an existing electrical connector, in accordance with an embodiment of the disclosure.

Referring generally to FIGS. 4A and 4B, these figures show how the power tap connector 200 may be electrically coupled with a non-mating end 135 of the electrical connector 130. The electrical connector 130 may comprise high current terminals 150. Each of the high current terminals 150 may further comprise a high current wire interface 160 for electrically coupling with the high current wire 120 and a high current terminal contact 170 for electrically coupling with a mating terminal of a corresponding mating connector.

FIG. 4A shows a cross-sectional view of the electrical connector 130 with a high current terminal 150 electrically coupled with a high current wire 120. In this embodiment, the high current terminal 150 is electrically coupled to the high current wire 120 via a soldered connection at the high current wire interface 160 portion of the high current terminal 150. In some embodiments, the high current terminal 150 may be electrically coupled with the high current wire 120 and then inserted into the insulative housing 133 of the electrical connector 130.

In FIG. 4A, the lower power tap housing 210 assembly of the power tap terminal 220 is being inserted into the non-mating end 135 of the electrical connector 130. The power tap terminal 220 is shown only partially inserted into the non-mating end 135 of the electrical connector 130. In the lower power tap housing 210 assembly, the power tap terminal 220 has been physically coupled with the lower power tap housing 210 and electrically coupled to a low current wire 420.

As the lower power tap housing 210 assembly is being inserted into the non-mating end 135 of the electrical connector 130, an outer portion of the lower power tap housing 210 extends around a portion of the non-mating end 135 of the electrical connector 130. The non-mating end 135 of the electrical connector 130 contains the high current wire interface 160 portion of the high current terminal 150 and the high current wires 120. The mating end 137 of the electrical connector 130 contains the high current terminal contact portion 170 of the high current terminal 150.

In some cases, the electrical connector 130 may not have been originally designed or configured to accommodate the electrical connection in the manner shown in FIG. 4A. However, in those cases some embodiments of the power tap connector 200 may be able to take advantage of the tolerances and/or spaces built into the electrical connector 130 that are used in order to accommodate the high current wires 120 and the high current terminals 150.

These tolerances and/or spaces allow the power tap terminal contact 240 to traverse between a surface of the high current terminal 150 and a portion of the housing 133 of the electrical connector 130. Once the power tap terminal 220 is fully inserted into the electrical connector 130, the surface of the power tap terminal contact 240 is electrically coupled with the surface of the high current terminal 150. Also shown in FIG. 4A, the power tap terminal securing tap 247 resists the backing out of the power tap terminal 220 during insertion into the electrical connector 130.

The power tap contact arch 245 of the power tap terminal contact 240 shown in FIGS. 4A and 4B is configured to contact a surface of the high current terminal 150, thereby establishing an electrical coupling. In this particular embodiment, the power tap terminal contact 240 contacts one surface of the high current terminal 150 and the opposing surface of the high current terminal 150 is the high current wire interface 160.

The high current wire interface 160 is where the high current wire 120 is electrically coupled to the high current terminal 150, for example, via soldering. Of course, the high current wire interface 160 comprising solder is an illustrative embodiment only for the purposes of simplifying the description of this disclosure. In other embodiments, the high current wire 120 may be electrically coupled to the high current terminal 150 via the high current wire interface 160 in a number of various ways depending upon the application. For example, the high current wire 120 may be wire crimped to the high current terminal 150 or fastened by other appropriate methods such as threaded fasteners, and bladed connectors, among others.

In FIG. 4B, the lower power tap housing 210 assembly has been fully inserted into the non-mating end 135 of the electrical connector 130. The contact between the power tap contact arch 245 of the power tap terminal contact 240 and the surface of the high current wire interface 160 of the high current terminal 150 is more fully securely and reliably established. Once the lower power tap housing 210 assembly has been fully inserted, the upper power tap housing 250 may be releasably coupled to the lower power tap housing 210 assembly via securing mechanisms 260 (not visible in these figures).

Once the lower power tap housing 210 assembly and the upper power tap housing 250 have been assembled, one end of the power tap connector 200 may encompassing the non-mating end 135 of the existing connector 130. In this embodiment, the non-mating end 135 of the electrical connector 130 has high current wire chambers 132 surrounding each of the high current wires 120. The high current wire chambers 132 may accommodate the thickness of the high current wires 120 and their insulation. In addition, the high current wire chambers 132 may also produce an exterior protrusion on the exterior surface of the electrical connector 130.

The power tap retention feature 270 is part of the releasable locking mechanism that engages the exterior protrusion of the high current wire chambers 132 to inhibit inadvertent removal or separation of the power tap connector 200 from the electrical connector, for example, such as through operation of an R/C model vehicle in rough off-road conditions. In this embodiment, the power tap retention feature 270 is shown as a relatively rectangular component engaging a substantially square surface of the exterior protrusion of the high current wire chambers 132. In other embodiments, various forms of releasable locking mechanisms may be used, such as snap fit features, fasteners, or latches, among other forms.

Use of a lower and upper power tap housings 210, 250, allows the housing of the power tap connector 200 to generate a clamping force to be applied to an exterior surface of the electrical connector 130, securing the power tap connector 200 relative to the electrical connector 130. In other embodiments, a single unitary power tap housing may be used for the power tap connector 200, however, there may need to be appropriate modifications made to the power tap retention feature 270 and or releasable locking mechanism.

Referring generally to FIGS. 5A and 5B, these figures contain an exemplary embodiment of a power tap system 500 in which the power tap connector 200 is shown fully engaged with an electrical connector 130 containing high current wires 120. In FIG. 5A, the power tap upper housing 250 is more readily visible along with the securing mechanisms 260 releasably joining the power tap upper housing 250 to the power tap lower housing 210. In FIG. 5B, the assembly is oriented upside down relative to FIG. 5A and the lower power tap housing 210 is more readily visible. In this figure, the low current wires 420 can be seen exiting one end of the power tap connector 200.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

It is the express intention of the applicant not to invoke 35 U.S.C. § 112, paragraph 6 for any limitations of any of the claims herein, except for those in which the claim expressly uses the words 'means for' together with an associated function.

What is claimed is:

1. A power tap connector for a model vehicle comprising:
a power tap housing comprising:
a power tap terminal electrically coupled to a power tap wire and comprising:
a power tap terminal contact; and
a high current wire separator configured to correspond to an exterior profile of a high current wire provided in an electrical connector;
wherein the power tap terminal contact is configured to electrically couple with a high current terminal electrically coupled to the high current wire provided in the electrical connector via a non-mating end of the electrical connector; and
wherein the power tap connector is configured to be physically secured in position relative to the electrical connector via a releasable locking mechanism.

2. The power tap connector according to claim 1, wherein the power tap terminal further comprises a power tap wire interface configured to electrically couple with the power tap wire.

3. The power tap connector according to claim 2, wherein the power tap wire interface comprises a wire crimping connection.

4. The power tap connector according to claim 1, wherein the power tap terminal contact comprises a power tap contact arch.

5. The power tap connector according to claim 1, wherein the releasable locking mechanism comprises a power tap retention feature configured to engage an exterior surface of the electrical connector.

6. The power tap connector according to claim 5, wherein the power tap retention feature comprises a protruding ridge.

7. The power tap connector according to claim 1, wherein the power tap housing further comprises:
a second power tap terminal electrically coupled with a second power tap wire, and comprising:
a second power tap terminal contact;
a second high current wire separator configured to correspond to a second exterior profile of a second high current wire provided in the electrical connector; and
wherein the power tap terminal contact is configured to electrically couple with a second high current terminal electrically coupled to the second high current wire provided in the electrical connector via the non-mating end of the electrical connector.

8. The power tap connector according to claim 1, wherein the power tap housing comprises:
a first power tap housing;
a second power tap housing;
wherein the first power tap housing and the second power tap housing are configured to surround the non-mating end of the electrical connector.

9. The power tap connector according to claim 8, wherein the power tap terminal is inserted in the first power tap housing.

10. A model vehicle comprising:

an electrical connector comprising:

high current terminals electrically coupled to high current wires;

a high current housing comprising a mating end and a non-mating end;

a power tap connector comprising:

a power tap housing comprising a first power tap housing and a second power tap housing coupled together;

high current wire separators that fit around exteriors of the high current wires;

power tap terminals electrically coupled to power tap wires wherein each power tap terminal comprises:

a power tap terminal contact;

a releasable locking mechanism physically coupling the power tap housing to the high current housing;

wherein the power tap terminal contacts electrically couple with the high current terminals via the non-mating end of the high current housing; and wherein high current wires pass through the power tap connector via the high current wire separators.

11. The model vehicle of claim 10, wherein the first power tap housing and the second power tap housing accommodate the non-mating end of the electrical connector.

12. The model vehicle of claim 10, wherein the power tap terminals are inserted into the first power tap housing.

13. The model vehicle of claim 10, wherein the releasable locking mechanism is incorporated into the second power tap housing and comprises a housing protrusion exerting a clamping force upon the non-mating end of the high current housing when the first power tap housing is releasably coupled to the second power tap housing.

14. A power tap connector for a model vehicle comprising:

a first power tap housing comprising;

a power tap terminal configured to electrically couple with a high current terminal of an electrical connector;

a second power tap housing releasably securable to the first power tap housing;

a releasable locking mechanism configured to physically secure the power tap connector to the electrical connector;

a wire separator configured to fit around an exterior of a high current wire of the electrical connector;

wherein the power tap terminal is configured to electrically couple with the high current terminal via a non-mating end of the electrical connector; and wherein the first power tap housing and the second power tap housing are configured to allow the high current wire to pass through the first power tap housing coupled with the second power tap housing via the wire separator when the power tap connector is coupled with the electrical connector.

15. The power tap connector according to claim 14, wherein the releasable locking mechanism is configured to be secured to the non-mating end of the electrical connector by physically coupling the first power tap housing to the second power tap housing.

16. The power tap connector according to claim 14, wherein the first power tap housing is physically coupled to the second power tap housing via a snap fit connection.

17. The power tap electrical connector according to claim 14, wherein the first power tap housing is rotatively coupled to the second power tap housing.

18. The power tap electrical connector according to claim 14, wherein the first power tap housing and the second power tap housing are configured to apply a clamping force to the non-mating end of the electrical connector when physically secured to each other.

* * * * *